US006089236A

United States Patent [19]

Alexsen

[11] Patent Number: 6,089,236

[45] Date of Patent: Jul. 18, 2000

[54] CIGAR HOLDER AND BURN RATE CONTROLLER

[76] Inventor: Andre Alexsen, 4514 Tobias Ave., Sherman Oaks, Calif. 91403

[21] Appl. No.: 09/116,013

[22] Filed: Jul. 15, 1998

[51] Int. Cl.[7] ..... A24F 5/04

[52] U.S. Cl. ..... 131/198.2; 131/175; 131/187; 131/235.1; 131/237.5; 131/241; 131/256

[58] Field of Search ..... 131/198.2, 198.1, 131/223, 231, 235.1, 237, 237.5, 240.1, 241, 256, 257, 260, 330, 175, 187, 190, 242

[56] References Cited

U.S. PATENT DOCUMENTS

| | | | |
|---|---|---|---|
| 1,725,196 | 8/1929 | Johnson | 131/235 |
| 3,405,719 | 10/1968 | Lustbader | 131/240.1 |
| 5,413,089 | 5/1995 | Andors et al. | 126/77 |

FOREIGN PATENT DOCUMENTS

| | | | |
|---|---|---|---|
| 840 937 | 7/1949 | Germany | 131/240.1 |

*Primary Examiner*—James Derrington
*Assistant Examiner*—Robert McBride
*Attorney, Agent, or Firm*—Stetina Brunda Garred & Brucker

[57] ABSTRACT

A cigar holder for controlling the burn rate thereof. According to a preferred embodiment, the invention comprises the combination of a housing member having an upwardly extending port formed thereon and a cigar holder member interconnectable therewith. The housing member is designed and configured to be positioned within an ashtray and has formed thereon at least one aperture for providing oxygen to a lit cigar received therewithin. The cigar holder member is designed to nest within the port formed on the base, and has formed thereon at least one aperture that is designed and configured to align with the aperture formed upon the base member. In use, the respective apertures formed upon the housing and cigar holder members may be selectively aligned with one another to define a resultant vent aperture of variable size which selectively controls the amount of air that can access the cigar to thus cause the cigar to burn at a controlled rate.

7 Claims, 1 Drawing Sheet

CIGAR HOLDER AND BURN RATE CONTROLLER

FIELD OF THE INVENTION

The present invention relates generally to smoker's articles, and more particularly, devices for holding and selectively controlling the burn rate of cigars during smoking.

BACKGROUND OF THE INVENTION

Although enjoyed for centuries, in recent years cigar smoking has become increasingly popular. In this regard, cigar sales have increased dramatically. Moreover, due to the introduction of several publications, namely, magazines, dedicated to the subject of cigar smoking, as well as a significant increase in the number of cigar smoking clubs, the consumption of cigars is likely to continue to rise.

Particularly in high demand are expensive and exotic cigars that are imported to this country. Indeed, such cigars are relished by smokers who wish to savor the flavor of such cigars and smoke the same at a relaxed and leisurely pace. Unfortunately, cigar smokers face substantial frustration in those circumstances where the smoker neither wishes nor is able to completely smoke a given cigar. In this respect, once a cigar is lit it is typically impractical or undesirable to only smoke a portion of the cigar, and save the remaining portion for a later time. Specifically, once the cigar is lit, the cigar may only be extinguished by rubbing the distal end thereof into the floor of the ashtray until the fire is snuffed out. Such well-recognized practice is not only messy, but frequently leaves the cigar is an unpleasing condition such that the desire to re-light and smoke the same at a later time is substantially diminished.

Additionally problematic with cigar smoking is the fact that once lit, cigars continue to burn at a relatively rapid rate during the time for which they are not being smoked (i.e., while being held, resting in an ashtray, etc.). As a consequence, a substantial portion of the cigar is wasted and never enjoyed. This drawback is especially problematic for cigar smokers who wish to prolong the smoking experience and savor the taste of a fine cigar.

Accordingly, there is a need in the art for an apparatus that can selectively control the rate at which a lit cigar burns during that portion of time the cigar is not being smoked, and more particularly, when such cigar is placed within an ashtray. Still further, there is a need in the art for such an apparatus that enables a cigar, once lit, to be selectively extinguished in a manner that does not damage the cigar, nor makes any mess or damages the structural integrity of the cigar so that the same may be re-lit and smoked at a later time.

There is additionally a need in the art for an apparatus that, in addition to controlling the burn rate of such cigar, can selectively position the cigar within an ashtray so that the same can be easily and readily accessed that can further accommodate virtually all types of cigars having a wide range of diameters. Such device would further advantageously be constructed such that the same is easy to utilize, of simple construction, relatively inexpensive to manufacture, and can be formed to have an attractive, aesthetically pleasing appearance.

SUMMARY OF THE INVENTION

The present invention addresses and alleviates the above-identified deficiencies in the art. Specifically, the present invention is directed to a cigar holder that selectively controls the rate at which a lit cigar burns. According to a preferred embodiment, the invention comprises the combination of a hollow housing member positionable within an ashtray and an annular cigar receiving apparatus/holder interconnectable therewith. The housing member has an upwardly angled port extending therefrom, the latter defining a hollow lumen extending therethrough. Formed upon the port is at least vent aperture that is designed and configured to allow air to pass within the hollow lumen of the port. The cigar receiving apparatus is axially positionable within the port and is designed to receive and support a cigar therewithin. In this regard, the receiving apparatus is preferably formed to have a generally tubular shape that defines an annular lumen extending therethrough. Formed upon the cigar receiving apparatus/holder is at least one aperture that is designed and configured to be selectively aligned with the aperture formed upon the port of the housing member such that in use, the respective apertures may be selectively aligned with one another to thus form a resultant vent opening that enables air to penetrate from outside the port and into the lumen of the receiving apparatus. By selectively aligning the respective apertures formed upon the port and the holder member, the resultant vent aperture may be selectively sized to thus limit the ability of air to enter to the burning cigar, which in turn selectively limits the rate at which such cigar burns.

It is therefore an object of the present invention to provide a cigar holder/burn rate controller that may be easily and readily utilized to hold a lit cigar and control the rate at which the same burns during the smoking thereof.

Another object of the present invention is to provide a cigar holder/burn rate controller that enables a cigar, once lit, to be selectively extinguished in a manner that does not damage the cigar, nor makes any mess or damage to the structural integrity thereof, so that the cigar may be re-lit and smoked at a later time.

Another object of the present invention is to provide a cigar holder/burn rate controller that maintains a lit cigar in a safe, upright configuration so that the burning portion thereof is maintained in a protected configuration.

Another object of the present invention is to provide a cigar holder/burn rate controller that may be formed to have a decorative design and finish that is aesthetically pleasing.

Still further objects of the present invention are to provide a cigar holder/burn rate controller that is of simple and durable construction, capable of being readily and easily utilized, and capable of being utilized with virtually all cigar shapes and sizes.

BRIEF DESCRIPTION OF THE DRAWINGS

These, as well as other features of the present invention, will become more apparent upon reference to the drawings, wherein.

DETAILED DESCRIPTION OF THE PREFERRED EMBODIMENT

The detailed description set forth below in connection with the appended drawings is intended merely as a description of the presently preferred embodiments of the invention, and is not intended to represent the only forms in which the present invention may be constructed or utilized. The description sets forth the functions and sequence of steps for constructing and implementing of the invention in connection with the illustrated embodiments. It is to be understood, however, that the same or equivalent functions and sequences may be accomplished by different embodiments that are also intended to be encompassed within the spirit and scope of the invention.

Figure 1:
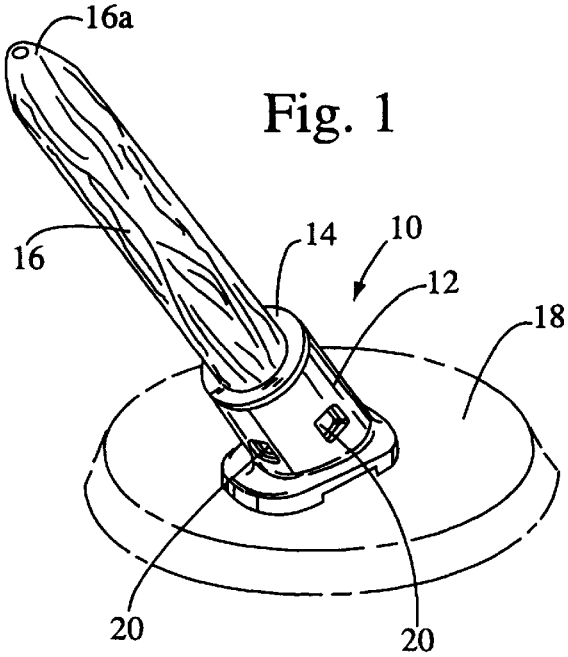
FIG. 1 is a perspective view of a cigar holder/burn rate controller device constructed in accordance with a preferred embodiment of the present invention having a cigar disposed therein, said device and cigar being shown disposed within an ashtray, the latter being shown in phantom.

Referring now to the drawings, and initially to FIG. 1, there is shown a cigar holder/burn rate controller 10 constructed in accordance to a preferred embodiment of the present invention. As perspectively illustrated, the device 10 comprises of the combination of a housing member 12 and a cigar receiving apparatus or holder member 14 axially nested therewithin. The housing 12 and holder member 14 cooperate to define a generally tubular passageway for holding and supporting a cigar 16. Specifically, the device 10 is designed and configured to maintain such cigar 16 in an upright, angled configuration within an ashtray such that the proximal end 16*a* thereof extends in a generally diagonal fashion. The lit distal portion of the cigar (not shown) remains axially disposed within the device and therefor safely maintained away from the hands of the smoker. The tubular passageway formed within the housing member 12 enables the ashes ultimately generated by the cigar to pass therethrough and become deposited within the ashtray, discussed more fully below in relation to FIG. 3.

To enable such distal portion of the cigar to remain lit, vent apertures 20 are provided to enable air to penetrate therethrough. As discussed more fully below, such vent apertures 20 are formed by the selective alignment of respective ones of apertures formed upon the housing member 12 and holder member 14 when the latter is nested therewithin.

Figure 2:
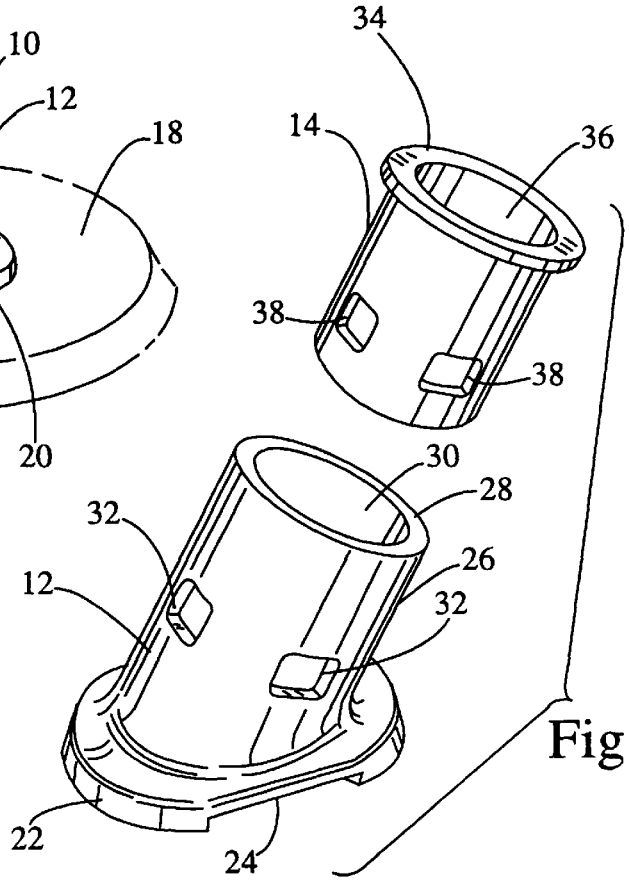
FIG. 2 is an exploded view of the cigar holder/burn rate controller apparatus depicted in FIG. 1.

As seen in FIG. 2, the housing member 12 is provided with a base portion 22 formed thereabout. As will be recognized, such base 22 provides support for the device 10 and enables the same to be positioned within a conventional ashtray. The base 22 may further preferably have formed thereon at least one slot 24 to enable air to penetrate within the device 10 to thus enable the lit distal end of the cigar disposed therein to continue to burn at a baseline rate (as opposed to becoming extinguished) to the extent the vent apertures 20 depicted in FIG. 1 are selectively closed off by the smoker.

Extending upwardly in a generally diagonal fashion from the housing 12 is tubular port 26. As illustrated, port 26 is formed to have a generally annular shape and having a generally annular rim 28 extending about the distal-most end thereof. Such tubular port 26 defines a tubular passageway 30 which, as discussed in more detail below, cooperates with the holder member 14 to define a tubular passageway for receiving and holding a cigar. The port 26 further has formed about the periphery thereof at least one, and preferably a plurality of apertures 32.

The holder member 14 is axially positionable within the port 26 of the housing member 12. As illustrated, the holder member 14 is preferably formed to have a generally tubular shape defining an annular tubular passageway 36 therethrough that is specifically sized to fit within the tubular passageway 30 defined by port 26. Formed upon the distal-most end of the holder member 14 is an annular rim or lip 34 which is designed and configured to rest upon and engage with rim 28 of the housing member 12, as depicted more clearly in FIG. 3. Advantageously, the cigar 16 has therefor maintained an upright configuration such that the lit portion thereof is safely maintained away from the hands of the smoker while the ashes produced thereby are confined within the ashtray 18.

Figure 3:
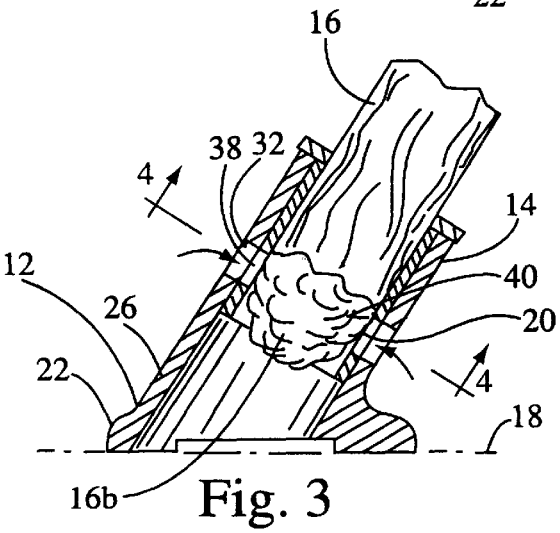
FIG. 3 is a cross-sectional view of the cigar holder/burn rate controller having the distal portion of a lit cigar disposed therewithin.
Figure 4:
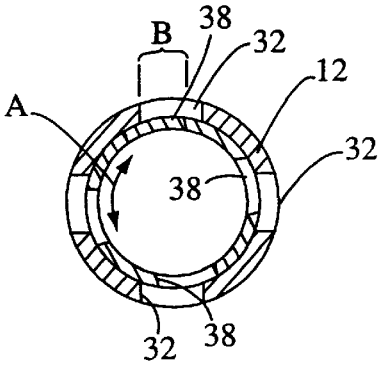
FIG. 4 is a cross-sectional view taken along line 4—4 of FIG. 3.

The holder member 14 further preferably has formed thereon at least one aperture, and preferably a plurality of apertures 38 that are designed and configured to be selectively aligned with respective ones of the apertures 32 formed upon the port 26 of the housing member 12. As illustrated in FIG. 3, when the holder member 14 is axially nested within the port 26 of the housing member 12, the apertures 38 may be selectively aligned with apertures 32 to thus define resultant vent apertures, such as 20 depicted in FIGS. 1 and 3. As illustrated in FIG. 4, the cigar holder apparatus 14, when nested within the port 26 of the housing member 12, is free to rotate therewithin such that apertures 38 formed thereon may be selectively aligned with respective ones of the apertures 32 formed upon the port 26. By rotating the cigar holder apparatus 14 in the circular pathway indicated by the letter A, respective ones of apertures 38 and 32 may be selectively aligned with one another to produce resultant vent apertures having a variable size, as indicated by the letter B. To the extent the smoker wishes to allow the cigar to freely burn, the smoker need only rotate the cigar holder apparatus 14 such that the apertures 38 formed thereon align with apertures 32 such that the resultant aperture, such as 20 depicted in FIG. 1, achieve a maximum size. To the extent that the smoker wishes to limit the rate at which the cigar burns, the cigar holder 14 may be rotated such that the apertures 38 formed thereon only partially align and overlap with apertures 32 formed upon the port 26 so that the resultant apertures have a more limited size, as indicated by the spacing B depicted in FIG. 4. As will be appreciated, such resultant vent apertures 20 enable air to be drawn from outside the device 10 and into the hollow annular passageway thereof to thus enable the lit distal end 16*b* of the cigar 16 to continue to burn, as shown in FIG. 3.

Such novel feature thus enables the device 10 to selectively control the rate at which the cigar, and more particularly the lit distal end 16*b* thereof burns during smoking. As is well known to those skilled in the art, smoker's frequently enjoy savoring the taste of the cigar, and wish to prolong the smoking experience by limiting the rate at which the cigar burns. Advantageously, the device 10 of the present invention selectively allows the smoker to control the rate at which the cigar 16 burns by limiting the amount of air that is able to access the lit distal end of the cigar, which is necessary to keep the cigar 16 lit.

To the extent a smoker wishes to extinguish the lit cigar the smoker need only rotate the holder apparatus 14 to a point to where apertures 32 and 38 are aligned with one another, which thus prevents any air from directly accessing the lit cigar. To the extent that the device 10 is formed to have the vent slot 24 formed upon the base 22, such embodiment will enable the cigar disposed therein to remain lit and burn at a minimum baseline level, notwithstanding the lack of any vent apertures. In this regard, air will thus be able to access the lit portion of the cigar through the vent at a fixed rate determined by the size of such side vent 24. The size of vent 24 may be selectively chosen by methods known in the art to enable a cigar disposed within the device 10 to either burn at a minimum baseline level or, alternatively, extinguish after a given period of time.

The device 10 of the present invention may be formed of any of a variety of materials well known to those skilled in the art, including but not limited to, brass, stainless steel, aluminum, silver, gold or a variety of combinations thereof. The device 10 may further be formed to have a decorative finish and aesthetically pleasing appearance. Moreover, it will be recognized by those skilled in the art that the device 10 may be formed such that the housing 22 has multiple ports 26 extending therefrom to thus enable several smokers at one time to selectively position their lit cigars within such device and selectively control the rate at which each dedicated cigar disposed therein may burn.

Accordingly, although the invention has been described herein with specific reference to presently preferred embodiments thereof, it will be appreciated by those skilled in the art that various additions, modifications, deletions and alterations may be made to such preferred embodiment without departing from the spirit and scope of the invention. For example, the vent apertures for allowing air to access the lit portion of the cigar disposed within the device may take the form of any of a number of designs wherein the size of such aperture may be selectively manipulated. Additionally, the port formed upon the housing may take any of a variety of orientations. It is intended that all reasonably foreseeable additions, modifications, deletions and alterations be included within the scope of the invention as defined in the following claims.

What is claimed is:

1. A device for receiving and holding a lit cigar during smoking comprising:

a) a housing member positionable within an ashtray, said housing having a upwardly extending port formed thereon, said port defining a generally tubular passageway extending therethrough and having at least one first aperture formed thereon;

b) a cigar support apparatus positionable within said port formed on said housing member, said apparatus defining a tubular passageway therethrough being sized and configured to receive and hold the lit portion of said cigar therein, said apparatus having at least one second aperture formed thereon; and c) wherein when said cigar support apparatus is received within said port of housing member, said first aperture may be selectively aligned with said second aperture to produce a resultant vent aperture, said resultant aperture being designed and configured to enable air to penetrate through said housing member and cigar support apparatus and access said lit portion of said cigar to thus enable said lit portion to remain ignited.

2. The device of claim 1 wherein said first and second apertures are selectively alignable with one another such that said resultant vent aperture may be caused to have a selectively variable size.

3. The device of claim 2 wherein said port has a plurality of dedicated apertures formed thereon and said cigar holding device has a plurality of dedicated apertures formed thereon such that when said cigar support apparatus is received within said port of said housing, dedicated respective ones of said apertures formed upon said port may be selectively aligned with dedicated respective ones of said apertures formed upon said cigar holding apparatus such that a plurality of resultant vent apertures are formed thereby.

4. The device of claim 1 wherein said first aperture may be selectively aligned with said second aperture such that said resultant vent aperture formed thereby may selectively transition between a first open configuration and a second closed configuration.

5. The device of claim 1 wherein:

a) said housing member is formed from a metal selected from the group consisting of stainless steel, gold, silver, brass and aluminum; and a) said cigar holding apparatus is formed from a metal selected from the group consisting of stainless steel, gold, silver, brass and aluminum.

6. The device of claim 2 wherein said housing has a base formed thereon to support said device within said ashtray.

7. The device of claim 6 wherein said base member has at least one slot formed thereon for allowing air to access said lit portion of said cigar independent of the size of said resultant vent aperture.

* * * * *